US007335143B2

(12) United States Patent
Lundahl

(10) Patent No.: US 7,335,143 B2
(45) Date of Patent: Feb. 26, 2008

(54) EXERCISE DEVICE WITH GYROSCOPE REACTION FEATURES

(76) Inventor: Robert Dana Lundahl, 5830 Jefferson Blvd., Frederick, MD (US) 21703

( * ) Notice: Subject to any disclaimer, the term of this patent is extended or adjusted under 35 U.S.C. 154(b) by 60 days.

(21) Appl. No.: 11/267,414

(22) Filed: Nov. 7, 2005

(65) Prior Publication Data

US 2006/0122042 A1 Jun. 8, 2006

(51) Int. Cl.
*A63B 21/22* (2006.01)

(52) U.S. Cl. ..... 482/110; 482/148

(58) Field of Classification Search ..... 482/148, 482/110, 63–64; 224/576, 638, 643, 651
See application file for complete search history.

(56) References Cited

U.S. PATENT DOCUMENTS 5,039,091 A * 8/1991 Johnson ..... 482/64
5,104,120 A * 4/1992 Watterson et al. ..... 482/5
5,354,251 A * 10/1994 Sleamaker ..... 482/96
5,433,680 A * 7/1995 Knudsen ..... 482/57
5,565,002 A * 10/1996 Rawls et al. ..... 482/6
6,328,677 B1 * 12/2001 Drapeau ..... 482/72
2002/0132706 A1 * 9/2002 Sleamaker ..... 482/51
2004/0082438 A1 * 4/2004 LaStayo et al. ..... 482/8
2007/0004564 A9 * 1/2007 Warner et al. ..... 482/57

* cited by examiner

*Primary Examiner*—Lori Amerson

(57) ABSTRACT

An exercise machine that can simulate the act of paddling a kayak with a spinning flywheel to provide exercise resistance and also produce a gyroscopic force to rock the exercise platform for a realistic effect. The flywheel is mounting on a shaft with moving supports that allow the flywheel and shaft to articulate in one plane only. Paddling inputs from the operator cause the flywheel to spin and also apply a force couple to the flywheel shaft itself in a direction where there is freedom of movement. The force couple applied to the spinning flywheel shaft causes a gyroscopic reaction force that is 90 degrees offset and in a new plane where the mounting method for the shaft does not provide a freedom of motion to articulate. In this plane the forces are transmitted to the exercise platform and cause a rocking reaction due to the gyroscopic force of the spinning flywheel.

9 Claims, 3 Drawing Sheets

EXERCISE DEVICE WITH GYROSCOPE REACTION FEATURES

BACKGROUND OF THE INVENTION

1. Field of the Invention

This invention relates to exercise machines, particularly to an exercise machine with reactive features to motion.

2. Brief Description of Related Art

There are many types of personnel exercise equipment and most can be categorized as "free weights", weight machines, or aerobic machines. Aerobic machines are very popular and provide the user with a low impact activity that can be performed on a single machine which is convenient to use and easy to learn. Treadmills, stair climbers, elliptical trainers, skiers, rowers, and stationary bicycles are all typical examples. These machines can be very effective for weight loss and cardiovascular fitness if used properly. With aerobic machines it is the time spent exercising that is the most important factor in their effectiveness.

Many of the current design aerobic machines are boring to operate. As a result, people quickly loose interest, the time spent exercising is decreased, and the effectiveness of their exercise program is compromised.

In a prior art U.S. Pat. No. 6,106,436, an "Exercise device and method to simulate kayak paddling" was disclosed. However the device only simulates paddling motion, but does not simulate reaction to the motion.

SUMMARY OF THE INVENTION

The purpose of this invention is to add a new dimension to the operation of an aerobic machine that makes the exercise program more interesting, more engaging, and more fun.

This invention describes a general technique where exercise resistance is provided by a spinning flywheel and the flywheel is mounted in such a way that it is caused to pivot in response to the operator inputs, and the pivoting action of the spinning flywheel causes a gyroscopic force which is counteracted by the operator. This "closed loop" mechanical system provides a new dimension to the exercise experience that is dynamic and more closely resembles the action and reaction systems encountered in real world activities.

DETAILED DESCRIPTION OF THE INVENTION

The following description presents only one application of the invention where a gyroscopic reaction system is incorporated into an exercise machine. Many such applications are possible and anticipated.

Figure 1:
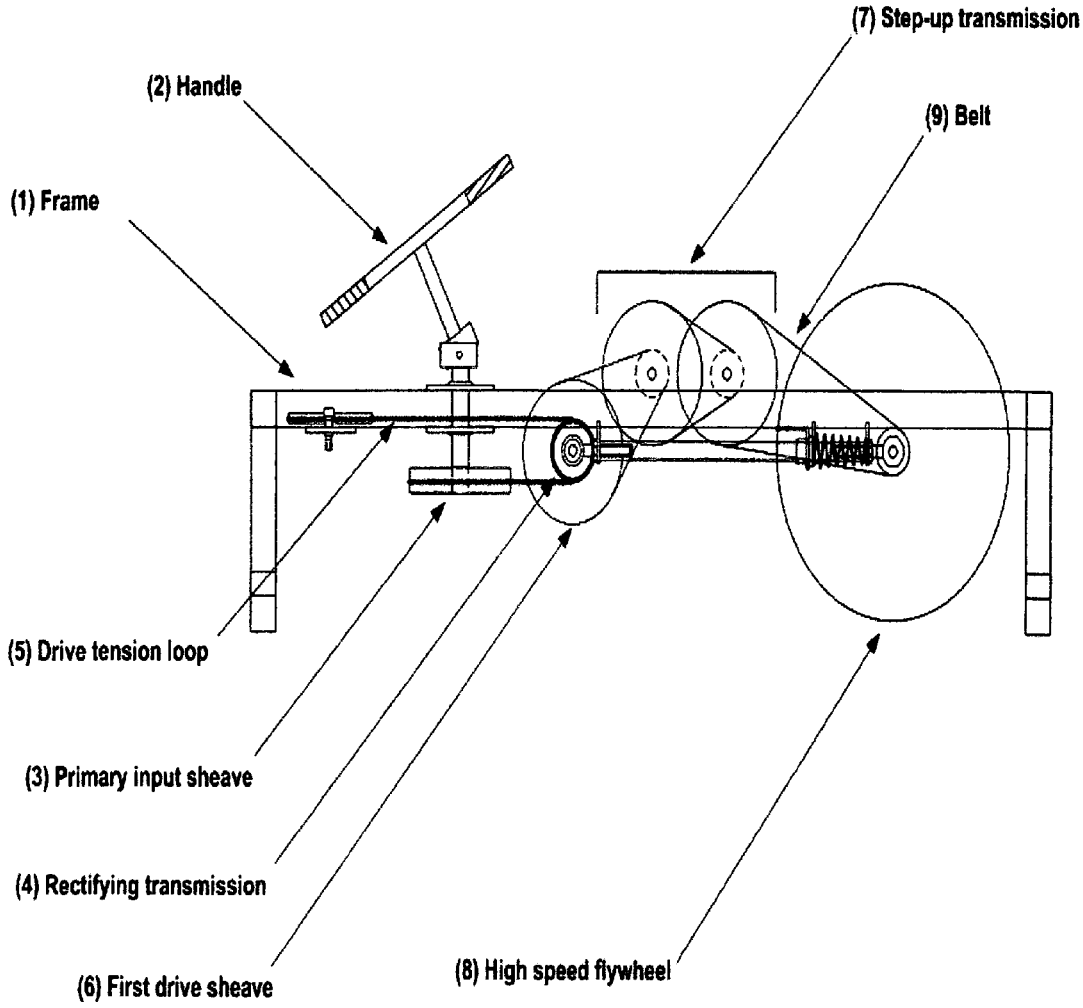
FIG. 1 shows how the gyroscopic reaction is incorporated in an exercise device that simulates kayak paddling.

FIG. 1 shows how the gyroscopic reaction principal is incorporated in an exercise device design which simulates kayak paddling. In FIG. 1, and as described in the previous U.S. Pat. No. 6,106,436, the operator sits on the machine surface (1) and performs paddling type strokes with the input handle (2). The oscillating rotations of the paddle input shaft are transmitted to the rectifying transmission (4) through a drive tensioned drive belt loop (5). The rectifying transmission (4) changes the oscillating input handle (2) into a unidirectional rotation of the first drive sheave. (6). This rotation is speeded up through as series of sheave combinations which form the step-up transmission (7). The high speed flywheel (8) is driven by belt (9) from the output of the step-up transmission (7) and this provides an inertial resistance. The inertial resistance to the operator inputs may be further enhanced by the previously described techniques to induce drag to the spinning flywheel.

Figure 2:
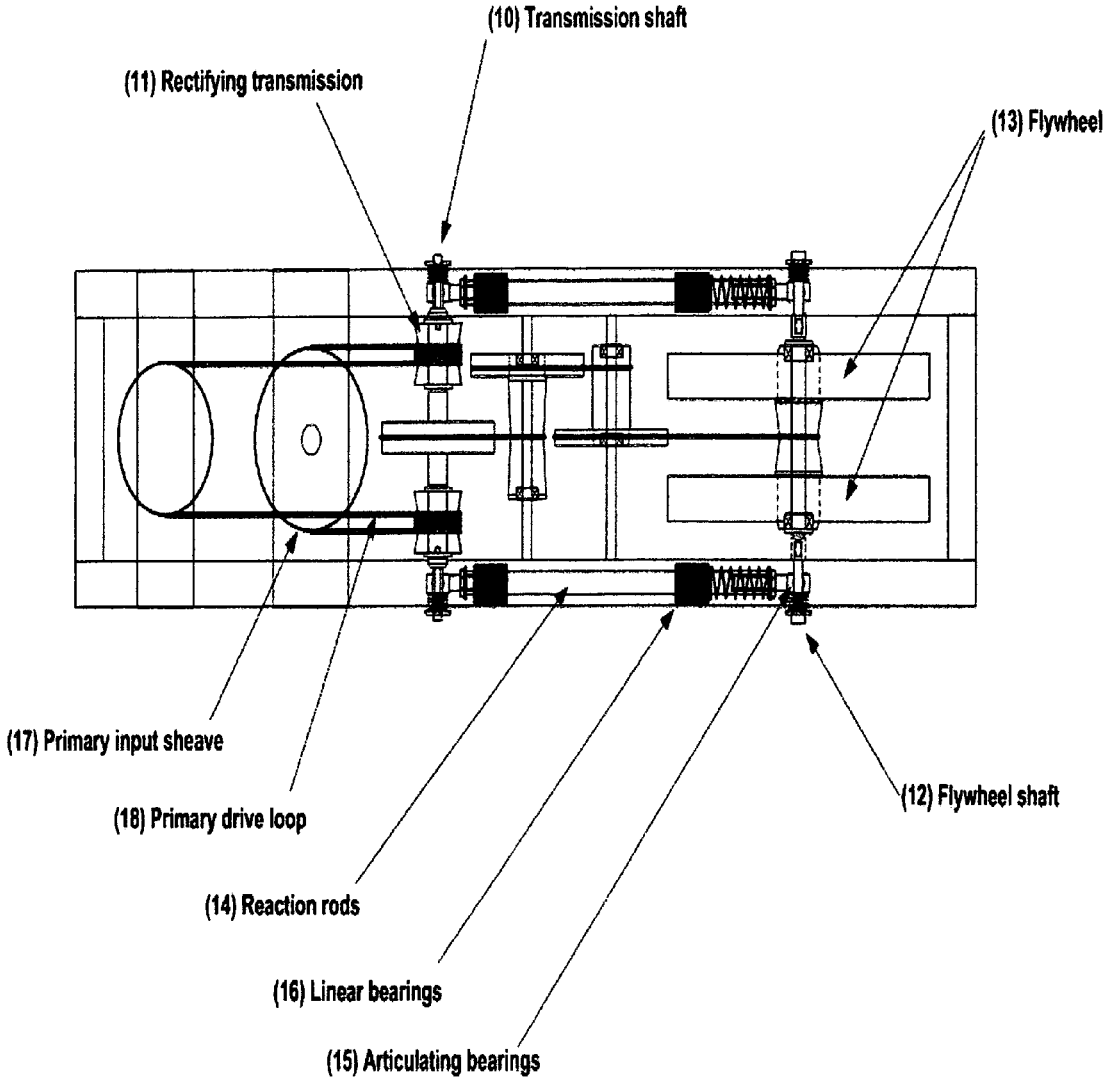
FIG. 2 shows a top down view f one embodiment of the invention.

FIG. 2 shows a top down view of one embodiment of the invention where a force component of the paddling input is used pivot the high-speed flywheel and cause a powerful gyroscopic to be countered by the operator. In this design, the shaft (10) of the rectifying transmission (11) and the shaft (12) of the flywheel (13) are attached to a pair of reaction rods (14) that form a "walking beam" configuration. The transmission and flywheel shafts are supported by two reaction rods connected with articulating bearings (15). The two reaction rods are themselves connected to the frame of the machine with linear bearings (15). This method provides vertical support for the transmission and flywheel shafts and allows them to pivot together in the horizontal plane. The reaction rods (14) move in their axial direction and in the direction of the force applied by the primary input sheave (17) through the drive belt loop (18). The end result is that the alternating rotational inputs of the paddle input handle (FIG. 1—item (2)) not only causes rotation of the high speed flywheel (FIG. 1—item (8)), they also provides an alternating force couple to be applied to its rotational axis of the flywheel shaft (FIG. 2 item (12)) itself. As flywheel (FIG. 2—item (13)) speed increases, the force couple caused by the paddling action will begin to provide a powerful and alternating gyroscopic reaction.

Figure 3:
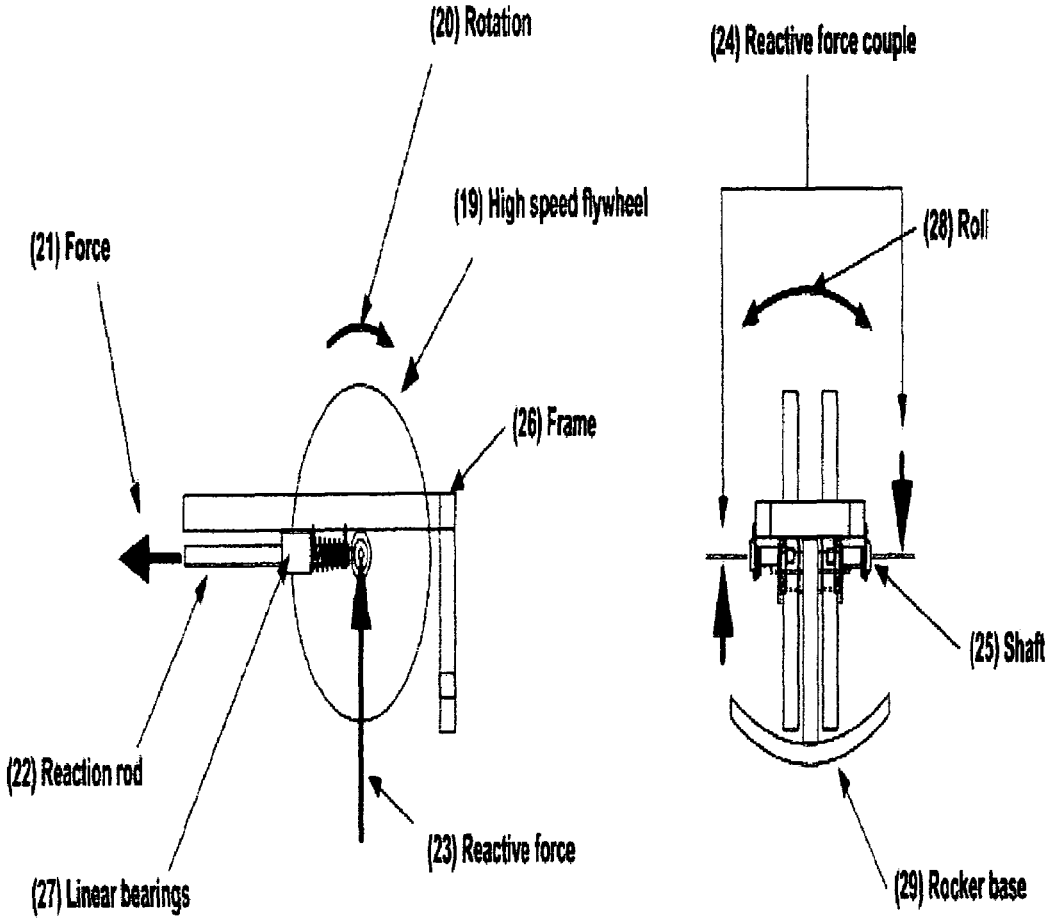
FIG. 3 shows the forces and gyroscopic reaction of the flywheel governed by the rules and physics of gyroscopic behavior.

FIG. 3 shows the forces and gyroscopic reaction of the flywheel (19) governed by the rules and physics of gyroscopic behavior. When the high speed flywheel (19) with a direction of rotation (20) has a force (21) applied to its axis through the reaction rod (22), the high speed flywheel (19) will produce a reactive force (23). This reactive force is one half of a reactive force couple (24) applied to the shaft (25) of the high speed flywheel. This reactive force couple (24) is transmitted to the machine structure (26) through the liner bearings (27). The reactive force couple (24) will encourage the machine structure (26) to roll (28) about it longitudinal axis. A rocker base (29) or other technique can be used to provide this mechanical degree of freedom.

This invention exploits the reactive force couple acting in this degree of freedom, which is different from the original operator input The net effect is that once the flywheel is up to a speed, paddling forces will not only be resisted by the flywheel drag and inertia, they will also produce a powerful gyroscopic force to realistically rock the machine from side to side about its longitudinal axis in response to alternating paddling inputs. The converse is also true where rocking the machine with a hip motion. Rocking the machine with the hips this would cause a reaction by the spinning flywheel that would transmit a reactive force that could be resisted by the paddling input. This combination of forces would also impart a rotational couple in the horizontal plane. Rollers or other devices incorporated with the rocker base can be used to exploit this rotational couple to and allow the machine to rotate in the horizontal plane about a fixed point on the ground.

The padding exercise device is a perfect candidate for the gyroscopic reaction system and this machine would provide a totally new dimension to the exercise experience. Several other exercise machines can be envisioned which could incorporate the gyroscopic reaction system as well.

While the preferred embodiment of the present invention has been described, it will be apparent to those skilled in the art that various modifications may be made in the embodiment without departing from the spirit of the present invention. Such modifications are all within the scope of this invention.

The invention claimed is:

1. An exercise device, comprising:

at least one flywheel to provide an exercise resistance and gyroscopic reaction to an operator's input;

wherein said flywheel is attached to a frame;

wherein the method of attachment between the flywheel shaft and the frame provides freedom of movement of the shaft to pivot the flywheel axis in one plane only;

wherein an operator input is used to pivot the flywheel axis in the freedom of movement plane and the gyroscopic forces of the spinning flywheel is utilized to provide a reaction to the frame through the shaft of the flywheel axis in the plane where there is no freedom of movement;

wherein the frame is allowed to move as result of the gyroscopic reaction force transmitted to the frame; and wherein the gyroscopic force transmitted to the frame can be resisted by the operator.

2. The exercise device of claim 1, wherein the frame incorporates:

a seating surface for an operator to sit on;

a set of paddles for rider to hold on and mounted on said seating surface;

a first mechanism to move said handle in response to paddling of said operator and to give the operator a first sensation of paddling a kayak; and a gyroscopic mechanism whose axis of rotation is deflected to cause a gyroscopic reaction to give the operator a second sensation that there is a reaction to the paddling.

3. An exercise device comprising:

at least one flywheel whose drag and inertia provides an exercise resistance;

wherein said flywheel is attached to a frame with an articulating mount;

wherein said articulating mount provides freedom of movement to pivot the flywheel axis in one plane and no freedom of movement to pivot the flywheel axis in another plane;

wherein an operator input is used to pivot the flywheel axis in the freedom of movement plane and the gyroscopic forces of the spinning flywheel is utilized to provide a reaction to a structure frame through the flywheel axis in the plane where there is no freedom of movement;

wherein the structural frame is allowed to move as result of the gyroscopic reaction force which can be felt by the operator;

wherein the structural frame incorporates, a seating surface for an operator to sit on, a set of paddles for said operator to paddle against a frictional axis, a handle for rider to hold on and mounted on said seating surface, a first mechanism to move said handle in response to paddling of said operator and to give the operator a first sensation of paddling a kayak, and a gyroscopic mechanism whose axis of rotation is deflected to cause a gyroscopic reaction reaction to give the operator a second sensation that there is a reaction to the paddling;

wherein said first mechanism comprises an articulating joint connected to said handle and transmitting the rotational component of torque imparted by rotation of the handle to a torque resistance mechanism, which is the flywheel for providing inertia resistance to the operator, and wherein said gyroscopic mechanism imparts a reaction to said seating surface to impart a reaction to said operator.

4. The exercise device of claim 3, wherein a reaction link utilizes the gyroscopic reaction force of two of said flywheel to push two reaction rods against said seating surface.

5. The exercise device of claim 3, wherein each of said reaction rod comprises a linear bearing pushing an articulating bearing against the shaft of one of said flywheel at one end of said reaction rod, and at another end pushing against a shaft for transmission of said articulating point.

6. The exercise device of claim 4, wherein the reaction force of two said reaction rods create a reactive force couple to tilt the shaft of said two of said flywheel, thereby creating said second sensation that there is reaction to paddling.

7. The exercise device of claim 3, wherein the rotational axis of said gyroscopic mechanism is deflected by a force provided by a mechanical actuator operating under programmable control.

8. The exercise device of claim 3, further comprising a base for mounting said seating surface.

9. The exercise device of claim 3, further comprising rollers to allow said seating surface to rotate in a horizontal plane.

* * * * *